US007380478B2

(12) United States Patent
Harrington

(10) Patent No.: US 7,380,478 B2
(45) Date of Patent: Jun. 3, 2008

(54) LINEAR CAM MECHANICAL INTERLOCK

(75) Inventor: Gregory C. Harrington, Bradenton, FL (US)

(73) Assignee: Honeywell International Inc., Morristown, NJ (US)

( * ) Notice: Subject to any disclaimer, the term of this patent is extended or adjusted under 35 U.S.C. 154(b) by 522 days.

(21) Appl. No.: 10/845,979

(22) Filed: May 14, 2004

(65) Prior Publication Data

US 2005/0252322 A1 Nov. 17, 2005

(51) Int. Cl.
*G05G 11/00* (2006.01)
*G05G 13/00* (2006.01)

(52) U.S. Cl. ..... 74/483 R

(58) Field of Classification Search ..... 74/483 R, 74/567, 569, 89.23, 89.32; 477/96; 200/5 R, 200/18, 50.1
See application file for complete search history.

(56) References Cited

U.S. PATENT DOCUMENTS

| | | | | | |
|---|---|---|---|---|---|
| 708,724 | A | * | 9/1902 | Merrick et al. | 74/483 R |
| 2,409,762 | A | * | 10/1946 | Janes | 74/483 R |
| 2,642,753 | A | * | 6/1953 | Sheldon | 74/483 R |
| 2,647,415 | A | * | 8/1953 | Dean et al. | 477/57 |
| 2,784,265 | A | * | 3/1957 | Weide | 200/5 R |
| 3,384,722 | A | * | 5/1968 | Hanke et al. | 200/50.1 |
| 3,410,151 | A | * | 11/1968 | Adams et al. | 74/483 R |
| 3,710,055 | A | * | 1/1973 | Blonn, Sr. | 200/1 R |
| 3,842,653 | A | * | 10/1974 | Blonn, Sr. | 477/96 |
| 4,445,394 | A | * | 5/1984 | Yapp et al. | 74/501.6 |
| 4,796,480 | A | * | 1/1989 | Amos et al. | 74/483 R |
| 5,249,480 | A | * | 10/1993 | Harmon et al. | 74/483 R |
| 5,419,596 | A | * | 5/1995 | Okada et al. | 292/201 |
| 5,492,511 | A | * | 2/1996 | Kozminski | 477/27 |
| 5,542,891 | A | * | 8/1996 | Kettle et al. | 477/96 |

FOREIGN PATENT DOCUMENTS

| | | |
|---|---|---|
| FR | 73161 E | 9/1960 |
| GB | 535478 | 4/1941 |
| JP | 59083223 | 5/1984 |

* cited by examiner

*Primary Examiner*—Richard Ridley
*Assistant Examiner*—Matthew Johnson
(74) *Attorney, Agent, or Firm*—Matthew F. Lambrinos; Kermit D. Lopez; Luis M. Ortiz

(57) ABSTRACT

A master controller mechanical interlock including at least one linear cam to actuate multiple interlocks. Operation of the mechanical interlock is determined by the position of two cams, one of which may be connected to a key switch or a direction switch. A third cam may be incorporated to allow or restrict operation of the master controller operator interface when a predetermined configuration is selected of the operator interface, the key switch, and the direction switch.

4 Claims, 4 Drawing Sheets

LINEAR CAM MECHANICAL INTERLOCK

FIELD OF THE INVENTION

The present invention generally relates to the field of master controllers for railway vehicle use, and more particularly, to master controller mechanical interfaces such as those used on railway propulsion or braking systems.

BACKGROUND OF THE INVENTION

In modern rapid transit vehicles, such as railway vehicles, the braking and propulsion controls are often effected by a master controller. These master controllers typically include an operator interface, such as a handle, which can be moved from a neutral or coast position to either a propulsion or braking position to provide a control signal throughout the vehicle. Two additional controls are also commonly coupled to the operator interface on a master controller, a key switch and a direction switch. The key switch can be placed in one of several positions, which typically include an off, run, and special charge position. There may be fewer or additional positions, and the name for each position may also differ. The direction switch can either be in a locked position (neutral) or in one of two operational positions (left and right). The key switch is used to allow the master controller to function, and the direction switch is used to select the vehicle's desired direction (forward or reverse).

Recent master controller construction techniques include an operator's interface, such as a handle, which is connected to a cam that operates a series of microswitches or position sensors. These microswitches or sensors, in certain conditions, operate motor control relays. It is desirable, however, to prevent the operation of the key switch or the direction switch in certain configurations of the handle position. Should the switches be operated in an undesired configuration, the vehicle could be turned off without application of the brakes; the direction of the vehicle could be changed while the operator interface (handle) is in a propulsion position; or in the special charge mode (or test mode), the brakes must be applied or an operator or inspector could be injured should the vehicle move. Thus, it is an object of the present invention that undesired operation of the master controller be prevented.

SUMMARY OF THE INVENTION

The present invention generally relates to mechanical interlocks. An interlock system is described as applied to a master controller in such a manner as to allow operation of the master controller only in a prearranged configuration. A series of mechanical cam mechanisms are used to lock selected operations of the master controller to prevent undesired user selected configurations.

In one illustrative embodiment of the present invention, a disk cam is affixed to at least one of two user switches. A linear cam follower having a preconfigured surface is then allowed to travel on the surface of the disk cam, causing at least one additional linear roller follower to secure the master controller from entering an undesired configuration.

In some embodiments, multiple switches may be employed and multiple linear roller followers are allowed to travel on the surface of the linear cam follower, increasing the ability to limit operation of the master controller to only those specific conditions where both switches are in predetermined positions.

BRIEF DESCRIPTION OF THE DRAWINGS

The invention may be more completely understood in consideration of the following detailed description of various embodiments of the invention in connection with the accompanying drawings, in which.

Figure 1:
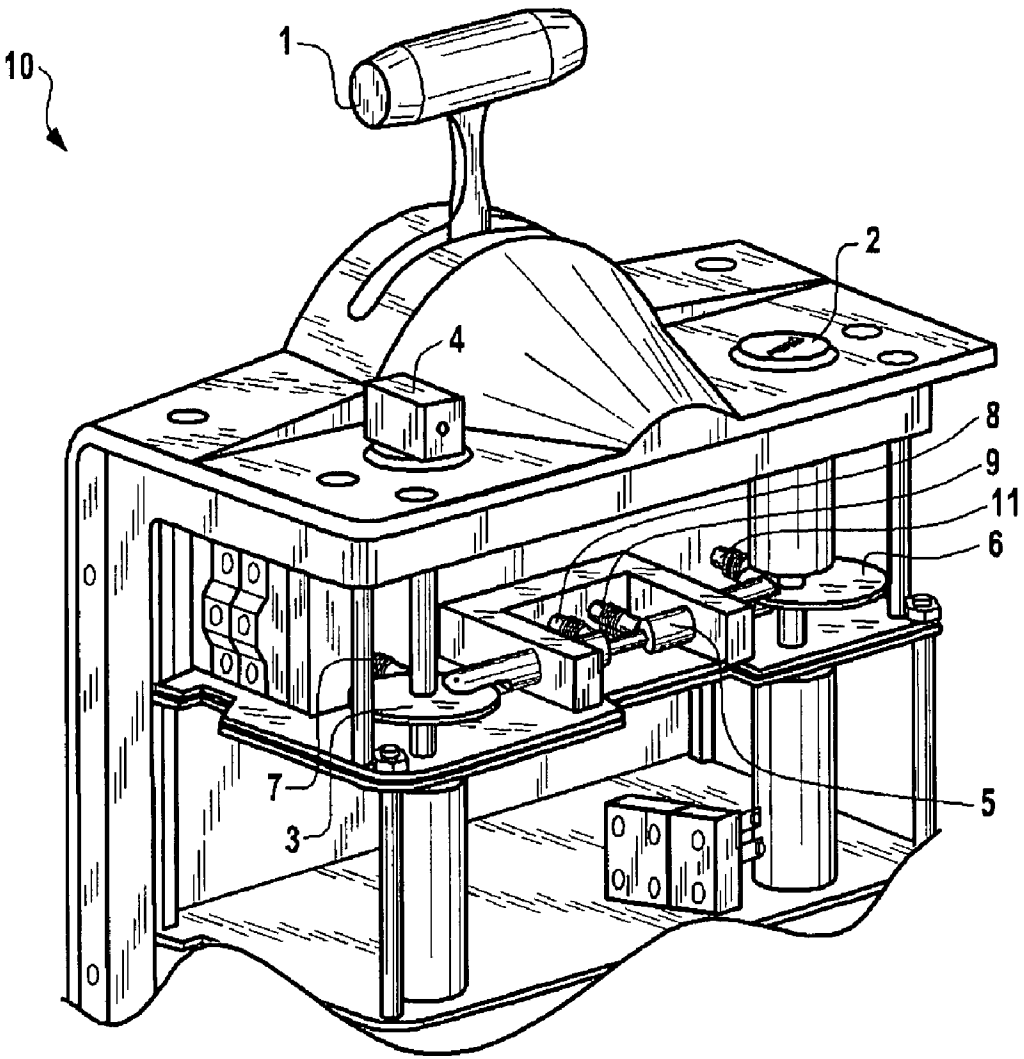
FIG. 1 is a three dimensional view of a master controller in accordance with the present invention.

While the invention is amenable to various modifications and alternative forms, specifics thereof have been shown by way of example in the drawings and will be described in detail. It should be understood, however, that the intention is not to limit the invention to the particular illustrative embodiments described. On the contrary, the intention is to cover all modifications, equivalents, and alternatives falling within the spirit and scope of the invention.

DETAILED DESCRIPTION OF THE INVENTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials may be illustrated for the various elements, those skilled in the art will recognize that many of the examples provided have suitable alternatives that may be utilized.

Generally, the present invention pertains to mechanical interlocks such as, for example, mechanical interlocks having at least one cam member. The present invention is applicable for use on mechanical interfaces which traditionally use numerous rotary cams to actuate interlocks between interacting controls. An appreciation of various aspects of the present invention will be gained through a discussion of the illustrative embodiments provided below. While the illustrative embodiment discusses the use of the present invention in a rail car application, one skilled in the art will find the invention can be used in any mechanical interlock application.

FIG. 1 is a three dimensional view of a master controller with a linear cam mechanical interlock according to an illustrative embodiment of the present invention. The master controller consists of elements used by the operator of the vehicle to control various aspects of the vehicle's movement, as well as a mechanical interlock below the operator's controls which can selectively engage or disengage certain vehicle functions according to predefined conditions.

An operator interface, shown by reference numeral 1, is shown as a handle and commonly used to send a braking, coast, or propulsion signal throughout the vehicle. This operator interface could also take the form of a lever or other object capable of passing motion to the mechanical interlock. More specifically, the operator interface can be placed in any one of the following positions: locked emergency, emergency, full service brake, braking, coast, power, and locked full service brake. As will be explained in detail below, depending on the configuration of the mechanical interlock, any number of these functions may or may not be available to the operator of the vehicle.

Also shown are two switches, a key switch 2, and a direction switch 4. When an operator inserts and turns the key switch 2, it actuates the mechanical interlock so as to allow operation of the direction switch 4 and the operator interface 1 in selected predetermined positions.

Direction switch 4 can typically be placed in either a locked neutral (LN) or a locked any (LA) position, depending on the position of the key switch 2 and the operator interface 1.

Figure 2:
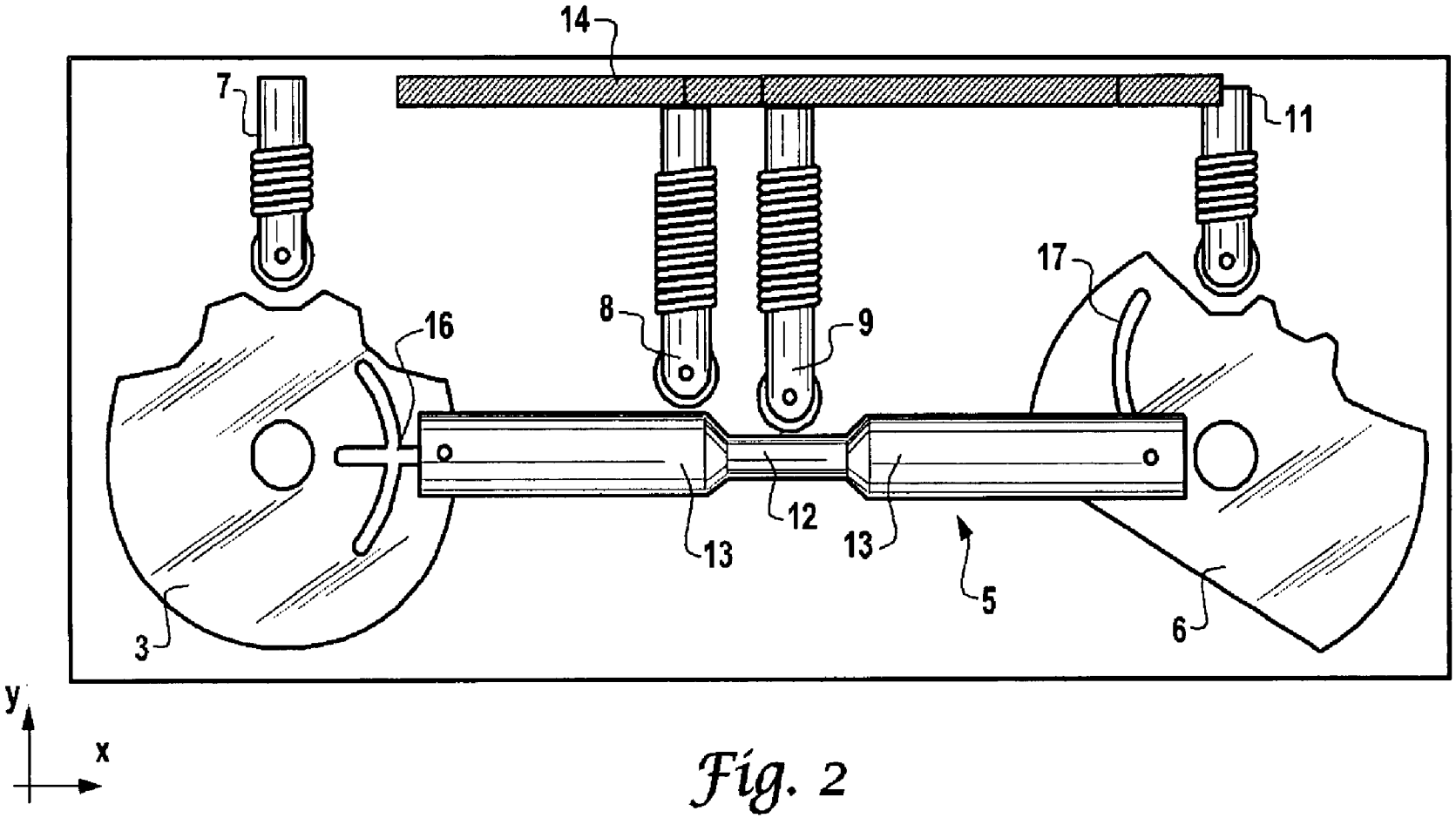
FIG. 2 is a cross-sectional view of the linear cam mechanical interlock according to an embodiment of the present invention.

FIG. 2 shows a cross-sectional view of the mechanical interlock beneath the operator's controls of FIG. 1. The mechanical interlock is comprised of two disk cams 3 and 6, four linear roller followers 7, 8, 9, and 11, and linear cam follower 5. While two disk cams are shown in the present embodiment, other types of cam mechanisms or gears may be substituted for the disk cams and are within the scope of the present invention. Other cams may include, but should not be limited to, translating, positive motion, cylindrical, yoke followers, and flat faced rollers. Likewise, while linear roller followers are shown, alternative cam followers may obviously be used, such as knife edge, flat face, spherical face, and the like. Also shown in FIG. 2 is an interlock operator interface plate 14, which is displaced about a common axis (not shown) with the operator's interface 1 of FIG. 1. Displacement of the interlock operator interface plate 14 may include or be limited to rotation about an axis. In an alternative embodiment, the interlock operator interface plate 14 may also move in a linear fashion.

Linear cam follower 5 may be manufactured from any material which will provide the strength and wear properties required for the intended application, such as hardened steel. The shape of linear cam follower 5 is chosen for the master controller by developing the linear logic necessary to effectuate the desired interlocking operation. This is easily accomplished by determining the desired Y position of each linear roller follower 8 and 9 for any specific operator control input, including and any incremental position between fully extended and fully retracted, and then by mapping each desired linear cam follower Y position for all X positions of the linear cam. The linear cam is then machined or cut so that the radius causes the linear roller followers 8 and 9 to actuate accordingly.

The linear cam follower 5 is mounted, preferably in bearings, to allow free movement in the X direction. Linear roller followers 7 and 11 are secured on the end of each disk cam 3 and 6, which allows the linear roller followers 7 and 11 to ride or travel on each disk cam 3 and 6. While FIG. 2 shows the linear roller followers 7, 8, 9, and 11 perpendicular to the linear cam follower and to the tangent of the disk cams, one skilled in the art may easily adapt the mounting method to secure the interlocks up to a 45 degrees deviation from that shown in FIG. 2.

When key switch 2 of FIG. 1 is rotated, cam 6 is also caused to rotate, which then actuates linear cam follower 5 to a predetermined position as determined by recess or slot 17 of FIG. 2 in disk cam 6. In FIG. 2, the key switch is shown in the special charge position, and the linear cam follower 5 is shown in the fully retracted positive X direction. Direction switch 4 of FIG. 1 is thereby locked through recess or slot 16 of FIG. 2 in disk cam 3 and prevented from moving. The linear roller followers 8 and 9 are either extended or retracted by the radius of the linear cam follower 5. In one alternative configuration, the linear cam follower 5 may be manually displaced (including rotation) by an operator, without the need for a key switch or a direction switch.

Figure 3:
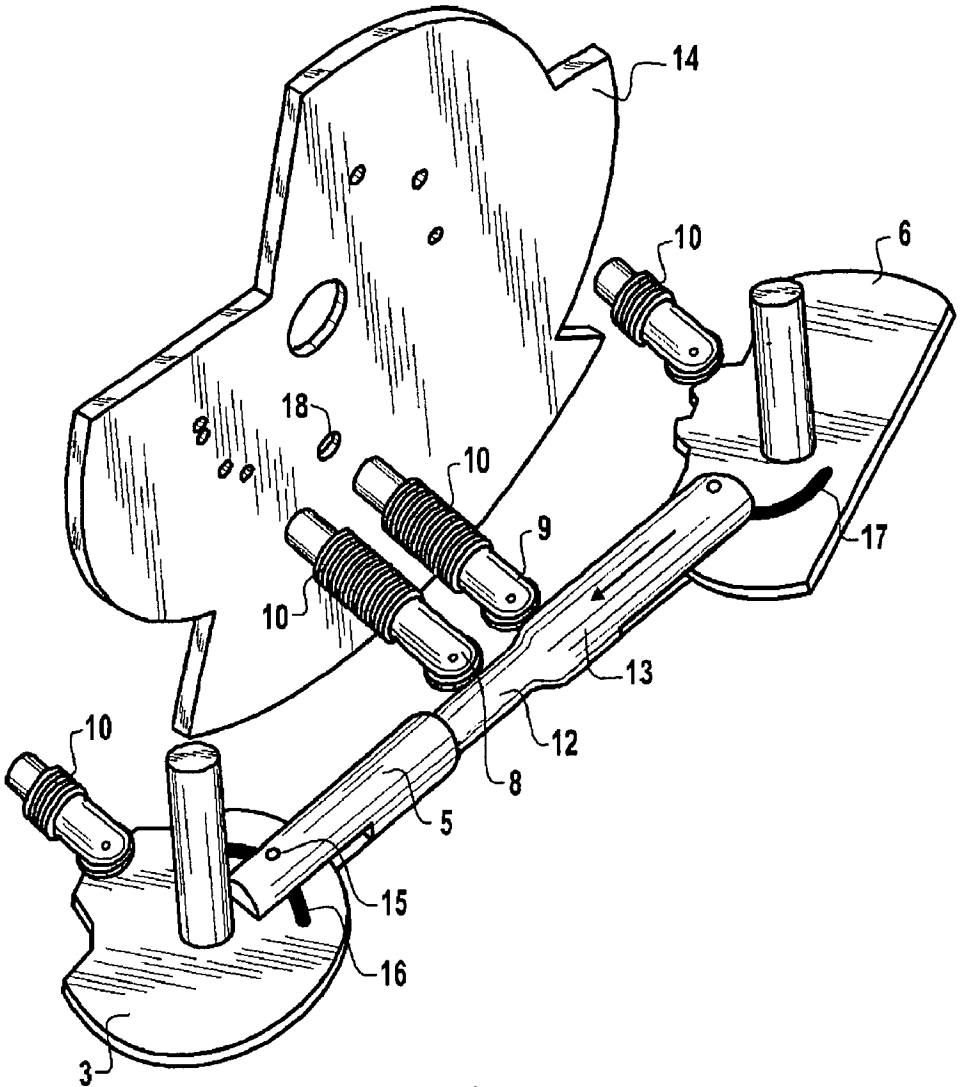
FIG. 3 is a three-dimensional view of the linear cam mechanical interlock of the present invention in an emergency position.

FIG. 3 is a three dimensional view of the mechanical interlock, showing a more detailed operation of the interlock operator interface plate 14. As shown in this figure, the key switch 2 of FIG. 1 is in an off state, and linear cam follower 5 is in a fully extended position in the negative X direction as driven by disk cam 6. The direction switch 4 of FIG. 1 and disk cam 3 are in a locked position by the locking pin 15 in recess or slot 16 of linear cam follower 5. The linear roller follower 9 is thus caused to be extended fully in the positive Y direction, by the increased radius 13 of linear cam follower 5, which engages and locks the operator interface plate 14, through hole 18 of FIG. 4, in the emergency position. Linear roller follower 8 is fully extended in the negative Y direction by the smaller radius 12 of linear cam follower 5. Actuation of the linear roller followers is caused by springs 10 which are suitably secured in the master controller.

The logic for positions of the key switch, directional switch, and allowable operator interface positions can be shown by the following table:

TABLE 1

| Key Switch Position | Operator interface Plate Position | Directional Switch Position |
|---|---|---|
| Off | Locked Emergency | Locked Neutral |
| Run | Emergency | Any |
| | Full Service Brake | Any |
| | Brake Range | Any |
| | Coast | Any |
| | Power Range | Locked Any |
| Special Charge | Locked Full Service Brake | Locked Neutral |

Figure 4:
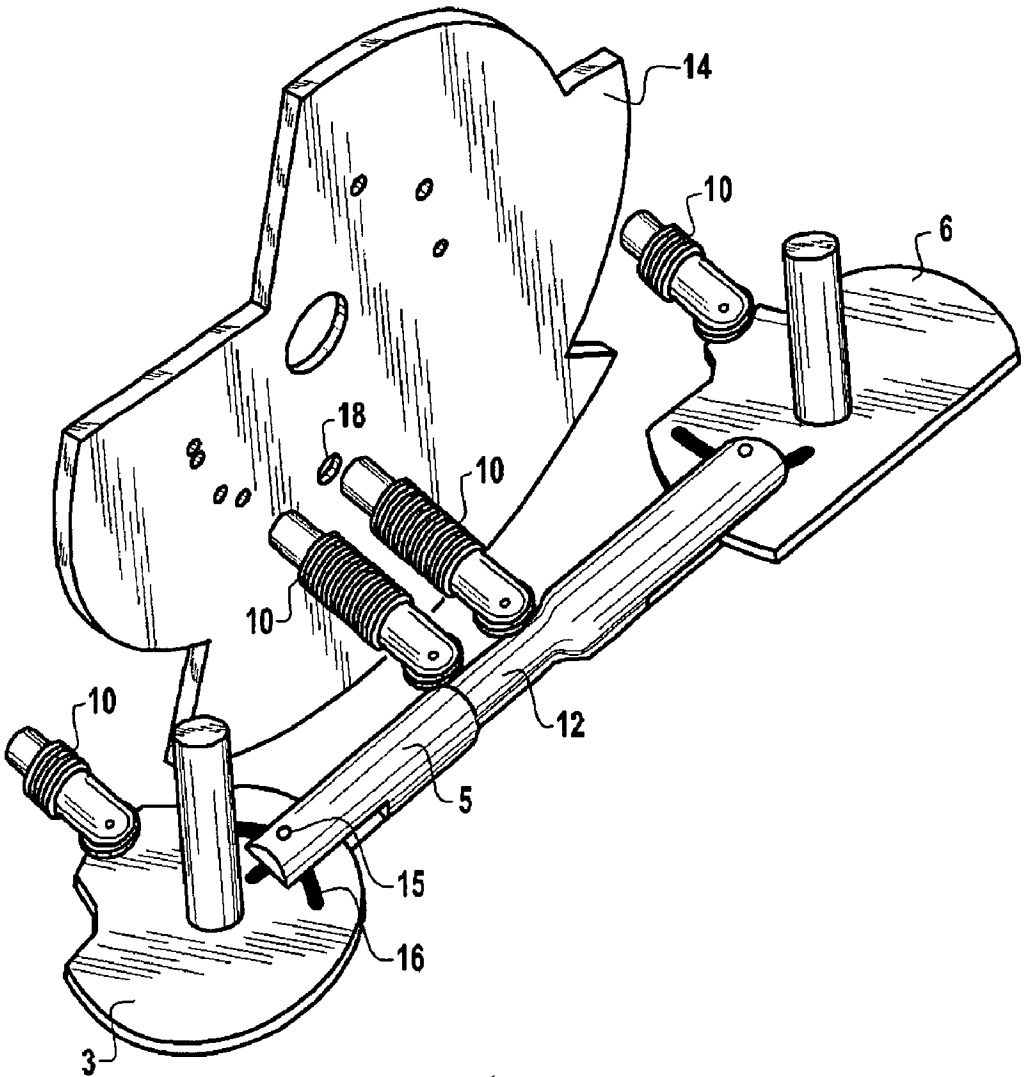
FIG. 4 is three-dimensional view of the linear cam mechanical interlock of the present invention in a run position.

FIG. 4 is another three dimensional view of the mechanical interlock with the key switch 2 (not shown) in the run position. This causes disk cam 6 to position linear cam follower 5 so that linear roller followers are both fully extended in the negative Y direction and located on the lower radius section 12. Locking pin 15 is positioned in recess or slot 16 so as to permit the direction switch 4 of FIG. 1 to move freely. The operator interface 1 of FIG. 1 and the operator interface plate 14 are then permitted to move to any of the positions identified in Table 1.

The present invention should not be considered limited to the particular example described above, but rather should be understood to cover all aspects of the invention as fairly set out in the attached claims. Various modifications, equivalent processes, as well as numerous structures to which the present invention can be applicable will be readily apparent to those of skill in the art to which the present invention is directed upon review of the instant specification.

What is claimed is:

1. A mechanical interlock comprising:

a disk cam having a slot or recess, a linear cam follower having a preconfigured surface, said linear cam follower being movable between extended and retracted positions in the X direction by said disk cam whilst traveling on a cam surface of said disk cam;

at least one linear roller follower having a roller and a follower, said linear roller follower changing rolling motion of said roller following said preconfigured surface of said linear cam follower to linear motion of the follower as said linear cam follower is displaced in said X direction by said disk cam;

an operator interface lockable by actuation of said linear roller follower engaging said operator interface;

a key switch affixed to said disk cam for actuating said disk cam to lock or unlock said operator interface via said linear cam follower;

another disk cam having a slot or recess; and a direction switch affixed to said another disk cam;

wherein said linear cam follower includes a locking pin arranged in said slot or recess of said another disk cam, said locking pin being positionable between a locking position and an unlocking position in said slot or recess as said linear cam follower displaces in the X direction, wherein said slot or recess of said another disk cam is adapted and arranged to allow said another disk cam to freely rotate when said locking pin is in the unlocking position and, when said locking pin is in the locking position, to prevent rotation of said another disk cam and allow said linear cam follower to displace between retracted and extended positions in the X direction.

2. The mechanical interlock according to claim 1, further comprising multiple linear roller followers and wherein said linear cam follower has a machined or cut radius so that said radius causes each of said multiple linear roller followers following said preconfigured surface of said linear cam follower to extend or retract to a Y position for a specific operator control input .

3. The mechanical interlock according to claim 2 wherein said linear cam follower has an increased radius and a smaller radius, said increased radius of said linear cam follower causing one of said linear roller followers following said preconfigured surface of said linear cam follower to fully retract said linear roller follower in a Y direction; and said smaller radius of said linear cam follower causing another one of said linear roller followers following said radius to fully extend in the Y direction.

4. The mechanical interlock according to claim 3, wherein said linear cam follower has a lower radius section causing both of said linear roller followers following said preconfigured surface of said linear cam follower to fully extend both of said linear roller followers in a negative Y direction and locate on said lower radius section of said linear cam follower when said linear cam follower is in a position in which said locking pin is in said unlocking position in said another disk cam slot or recess.

* * * * *